United States Patent [19]

Uhlirsch et al.

[11] 4,060,575

[45] Nov. 29, 1977

[54] COOLING TOWER AND WALL STRUCTURE THEREFOR

[75] Inventors: Kurt Uhlirsch; Hermann Lindhuber, both of Braunau, Austria

[73] Assignee: Vereinigte Metallwerke Ranshofen-Berndorf Aktiengesellschaft, Ranshofen near Braumau, Austria

[21] Appl. No.: 550,014

[22] Filed: Feb. 14, 1975

[30] Foreign Application Priority Data

Feb. 15, 1974 Austria ..... 1252/74
Feb. 15, 1974 Austria ..... 1253/74

[51] Int. Cl.[2] ..... B01F 3/04

[52] U.S. Cl. ..... 261/111; 52/83; 52/148; 52/224; 52/248; 52/630; 248/72; 261/DIG. 11

[58] Field of Search ..... 261/111, 112, DIG. 11; 52/62, 73, 63, 80, 83, 224, 246, 248, 249, 450–453, 618, 620, 630, 625, 671, 674, 245, 247, 629, 148, 244, 336, 675; 248/49, 58, 59, 63, 65, 72

[56] References Cited

U.S. PATENT DOCUMENTS

| | | | |
|---|---|---|---|
| 1,144,593 | 6/1915 | Heiser | 248/72 X |
| 1,302,544 | 5/1919 | Hartburg | 248/72 |
| 3,129,793 | 4/1964 | Ferrell | 52/73 |
| 3,151,947 | 10/1964 | Hastings | 52/630 X |
| 3,304,351 | 2/1967 | Sweeney | 52/224 X |
| 3,422,883 | 1/1969 | Daltry | 261/DIG. 11 |
| 3,444,558 | 5/1969 | Leitner | 52/630 X |
| 3,618,277 | 11/1971 | Waters | 52/245 X |
| 3,637,193 | 1/1972 | Kugler et al. | 261/DIG. 11 |
| 3,648,990 | 3/1972 | Stoker et al. | 261/111 X |
| 3,892,094 | 7/1975 | Spray | 52/80 X |

FOREIGN PATENT DOCUMENTS

| | | | |
|---|---|---|---|
| 2,154,530 | 2/1973 | Germany | 261/DIG. 11 |
| 2,232,399 | 1/1974 | Germany | 261/DIG. 11 |
| 2,232,400 | 1/1974 | Germany | 261/DIG. 11 |
| 586,020 | 10/1933 | Germany | 261/DIG. 11 |
| 2,109,174 | 9/1972 | Germany | 261/DIG. 11 |
| 1,183,193 | 3/1970 | United Kingdom | 261/DIG. 11 |

*Primary Examiner*—Tim R. Miles
*Assistant Examiner*—Richard L. Chiesa
*Attorney, Agent, or Firm*—Karl F. Ross

[57] ABSTRACT

A hyperboloidal cooling tower has a central post from which is suspended an upper horizontal ring centered on the post. A network of cables strung from the upper ring define a generally hyperboloidal surface, with the cables criss-crossing and the intersections clamped together with clips. A plurality of corrugated aluminum plates is secured inside the array of cables at the clips with the corrugations of the plates extending upwardly. The corrugations of each plate are spread to a greater and lesser extent at different regions along the plate together so that these plates may form a uniform three-dimensional shape. Each of the plates is secured at its central region fixedly to at least one clip and otherwise secured to the clips via stringers which can slide on these clips so as to allow thermal expansion of the plates relative to the cable network and relative to one another.

3 Claims, 8 Drawing Figures

COOLING TOWER AND WALL STRUCTURE THEREFOR

FIELD OF THE INVENTION

The present invention relates to a wall structure and, more particularly, to a chimney-type or hyperbolic cooling tower having an improved wall structure.

BACKGROUND OF THE INVENTION

A power-generating plant often employs cooling towers in order to reduce the temperature of the coolant used in the plant. This coolant is usually water and the cooling tower is arranged to pass atmospheric air through the water so as to cool it by conduction and evaporation.

In recent times the mechanical-draft type of tower has been increasingly replaced by the so-called hyperbolic natural-draft tower. This latter structure comprises a huge vertical tube or chimney often several hundred feet high and more than a hundred feet in diameter. The tube has the shape of a generally hyperboloidal body of revolution and has a lower outwardly flared mouth spaced above the ground. Between the lower edge of this tower and the ground there is provided so-called fill through which the hot coolant is trickled. Air entering the tower through this fill and passing over the water is heated conductively, simultaneously cooling the water by evaporating some of it. The heated air inside the tower then rises by convection and draws more air in through the fill. In this manner convective flow draws a large quantity of air over the water to be cooled without the use of any external energy.

Typically such a hyperbolic (also known as parabolic) cooling tower is made of reinforced concrete. Such construction is extremely expensive, and has the further disadvantage that, because of its great weight, a very strong supporting structure must be provided. It has also been suggested to use flat metal plates welded to a frame, however this arrangement has the further disadvantage that, when steel is used, it corrodes so that its service life is relatively limited, and at the same time the considerable thermal expansion of the metal can lead to injurious deformation of the tower structure. This thermal-expansion problem is particularly aggravated because the air pressing upwardly through the interior of the tower is frequently very hot, in the neighborhood of 60° -80° C, whereas the outside air is frequently much colder, especially at the top of the tower which may be as many as 400 feet above the ground. Furthermore when such a tower is taken temporarily out of use it cools quickly, thereby shrinking so that any latent defects in the structure are continuously aggravated by the considerable thermal shrinkage and expansion that it is subjected to.

OBJECTS OF THE INVENTION

It is therefore an object of the present invention to provide an improved wall structure.

Another object is the provision of an improved natural-draft cooling tower of the above-described general type.

Yet another object is the provision of such a tower which can be inexpensively and rapidly constructed, but which at the same time has a long service life.

A further object is to provide a cooling tower which is not damaged by thermal expansion as described above.

FIELD OF THE INVENTION

These objects are attained according to the present invention in an arrangement wherein a plurality of corrugated plates are used to make up the wall, their corrugations being spread to greater and lesser extents at different portions of the wall so that the plate may assume a thick three-dimensional shape conforming to a section of the paraboloidal or hyperboloidal surface of the wall structure. The corrugations of these plates in accordance with the invention are of trapezoidal section and extend vertically. Thus at the narrowest waist of the hyperboloidal wall the corrugations will be at minimum spacing, whereas at the flared upper and lower ends there will be a substantially greater spacing, with the region having a uniformly increasing spacing or spread.

A cooling tower in accordance with the present invention has an upright central post defining a vertical axis and suspending a horizontal upper ring which is centered on the axis. An array of criss-crossing cables are connected between the ring and the ground and define a generally hyperboloidal surface therebetween. Clips are provided at the intersections of the criss-crossing cables and a plurality of corrugated metal plates as described above are provided secured inside the array at the clips with these plates lying on or parallel to the hyperboloidal surface with their corrugations horizontally spread to greater and lesser extents at different vertical regions along the plates.

In accordance with further features of this invention at least some of the clips at the intersections are provided with means allowing limited displacement of the plates relative to the array of cables, the displacement direction being generally parallel to this array. Thus limited relative shifting of the plates relative to the cables and to one another is possible so as to allow the structure readily to compensate for thermal expansion and external forces, such as wind.

BRIEF DESCRIPTION OF THE DRAWING

The above and other objects, features, and advantages of the invention will become more readily apparent from the following description, reference being made to the accompanying drawing in which.

SPECIFIC DESCRIPTION

Figure 1:
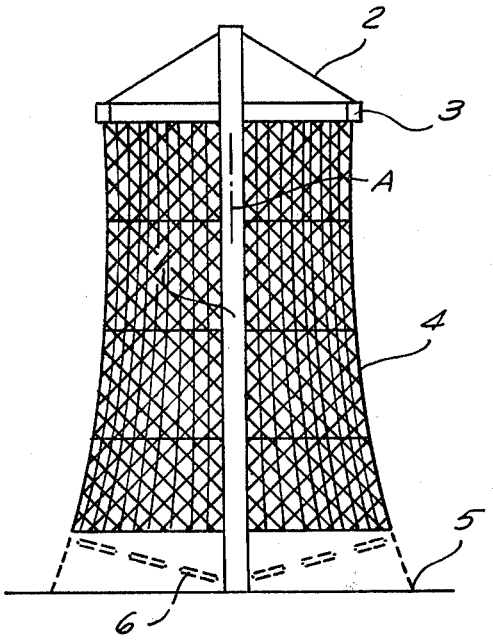
FIG. 1 is a vertical section through the cooling tower according to the present invention, largely in diagrammatic form.

As shown in FIG. 1 a natural-draft type of cooling tower is formed basically of a central vertical post 1 defining an axis A and provided with suspension cables 2 from which is hung an upper ring 3 which is circular and centered on the axis A. An array 4 of galvanized steel cables forms a hyperboloid centered on the axis A between the ring 3 and the ground where the cables of the network 4 are attached at 5. Cooling arrangements 6 are provided at the base of the arrangement.

The network 4 is formed of generally vertically extending cables 8 and criss-crossing generally helically extending cables 7. These cables 7 and 8 are connected at their intersections by clips 12 secured by means of bolts 12' and serving to support via H-section blocks 11 corrugated plates 9. As shown in FIGS. 2 - 8 these plates 9 have corrugations of trapezoidal section and these corrugations extend generally vertically.

Figure 6:
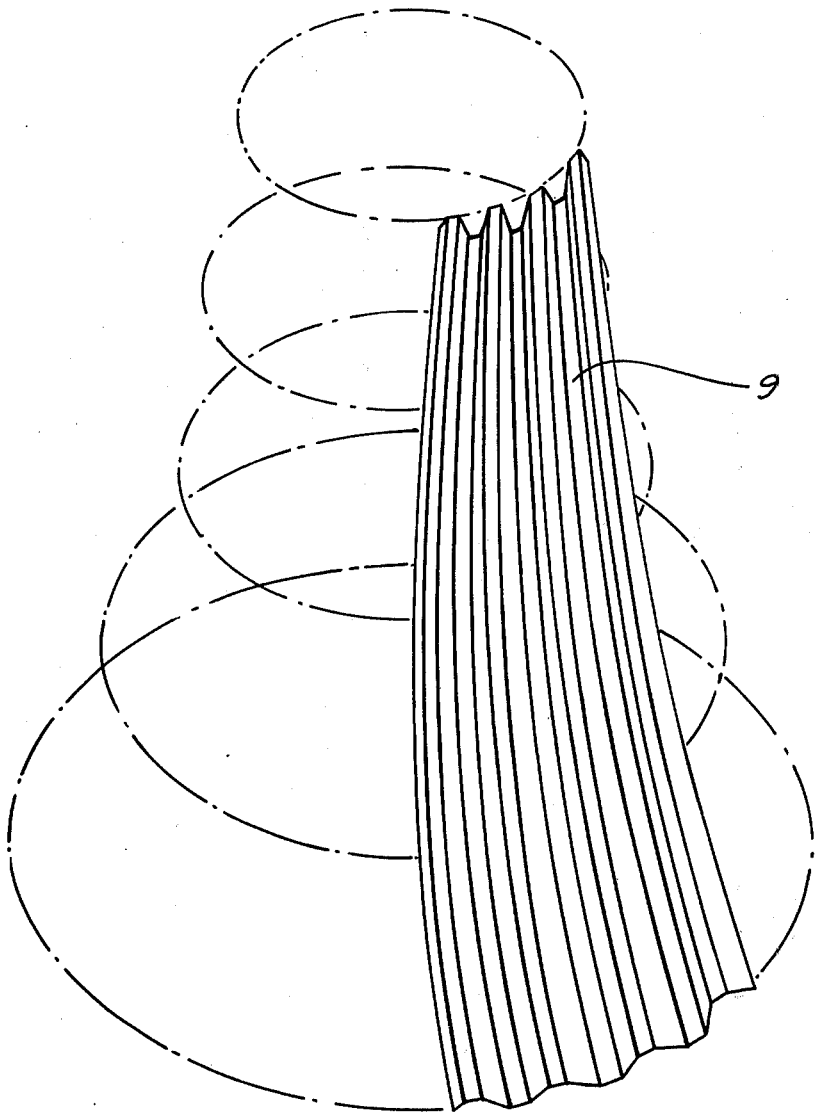
FIG. 6 is a perspective diagrammatic view of a cooling-tower liner.
Figure 7:
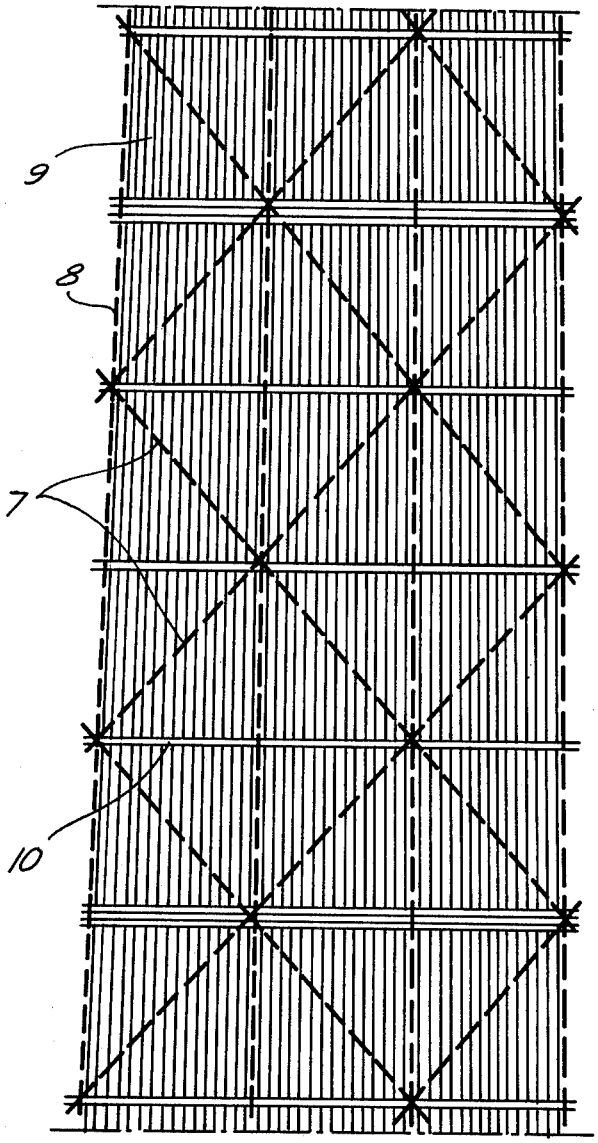
FIGS. 7 and 8 are, respectively frontal and vertical sectional views of portions of the wall structure of a cooling tower according to the present invention.

Each plate 9 has its corrugations extending generally vertically and is mounted on several horizontal stringers 10 having notched-out ends 17 adapted to fit in grooves 16 on the holder blocks 11. These stringers 10 are of U-section, open downwardly. The plates 9 are carried on the inside of the cable array 4 so that the cooling tower formed thereby has a smooth interior, with the cable network 4 being visible on the outside. The tower is constructed by securing the beams 10 to the holders 11 and thereafter fitting the plates 9 to them and riveting them in place. FIG. 6 shows how the corrugations at the lower broader end of the tower are spread more widely than at the top.

Figure 3:
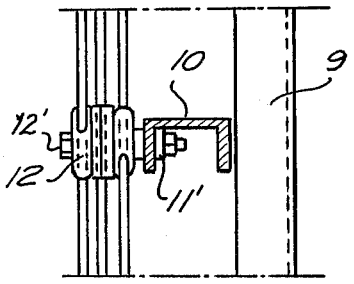
FIGS. 3–5 are vertical sections through details of FIG. 1.
Figure 4:
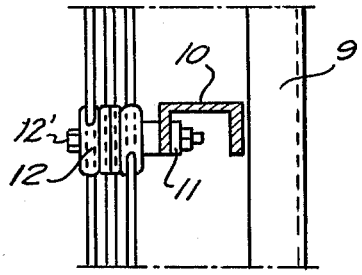
Figure 2:
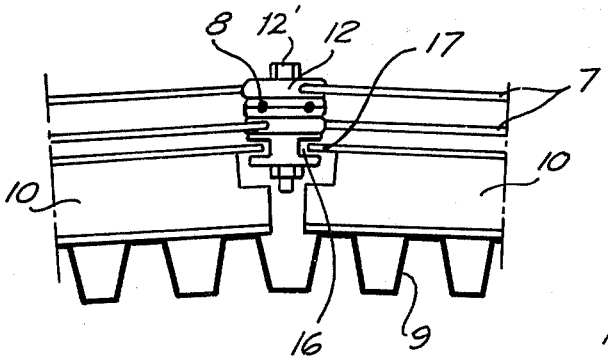
FIG. 2 is a horizontal section through a detail of the tower of FIG. 1.

Each plate 9 is held at several locations by its stringers 10 on blocks 11' which tightly clamp the inner flange of stringer 10 as shown in FIG. 3. Most of the blocks 11 however as shown in FIG. 4 allow relative displacement of the beam 10 and, hence, the plate 9 relative to the respective clip 12.

Figure 5:
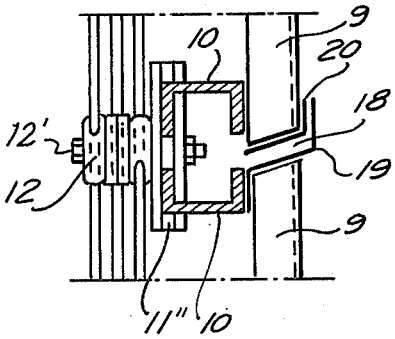

Other clips 11'' are provided as shown in FIG. 5 which receive a pair of such stringers 10 open toward each other and flanking the horizontal gap between the upper and lower ends of two adjoining plates 9. An L-section edge strip 20 is provided on the upper plate 9 and a Z-section strip 19 on the lower section 9, with the two being riveted together to the upper plate 9 so as to permit limited vertical displacement of the two relative to each other. All of the parts except for the plates 9 may be made of iron or steel. The stringers 10 may also be of T, I, or other cross section.

Figure 8:
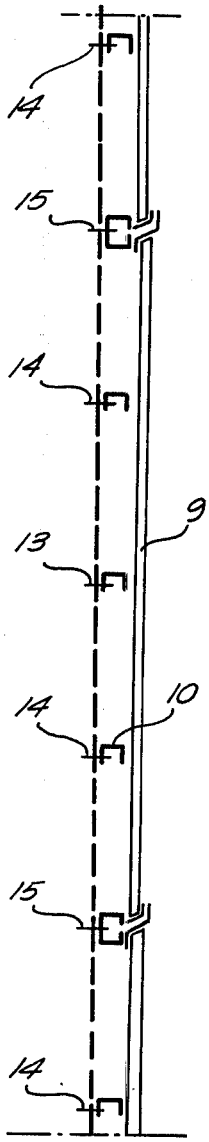

FIG. 8 shows how the plates 9, which each extend over several cables 7 and several cables 8, are secured at sliding joints 14 and 15 and at their central regions at fixed joints 13.

We claim:

1. In a cooling tower having an upwardly open chimney for inducing a flow of air therethrough and provided with means for supplying a cooling liquid thereto, a structure forming said chimney, said structure comprising:

an upright post defining an axis;

a horizontal upper ring suspended from said post and centered on said axis;

an array of cables hanging from said ring and defining thereunder a generally hyperboloidal surface centered on said axis, said cables crossing one another at intersections;

a plurality of clips each secured to said cables at a respective intersection;

a plurality of metal plates having vertical corrugations of generally trapezoidal section; and respective rigid stringers each secured to a plurality of said clips and extending across the width of each of said plates and fastened thereto, said stringers securing each plate to said array by said clips so that each plate lies on said surface with its corrugations horizontally spread to greater and lesser extent at different vertical regions along the plate.

2. In a cooling tower having an upwardly open chimney for inducing a flow of air therethrough and provided with means for supplying a cooling liquid thereto, a structure forming said chimney, said structure comprising:

an upright post defining an axis;

a horizontal upper ring suspended from said post and centered on said axis;

an array of cables hanging from said ring and defining thereunder a generally hyperboloidal surface centered on said axis, said cables crossing one another at intersections;

a plurality of clips each secured to said cables at a respective intersection; and a plurality of metal plates having vertical corrugations, each plate being secured to said array by said clips so as to lie on said surface with its corrugations horizontally spread to greater and lesser extents at different vertical regions along the plate, each plate having and being mounted on a plurality of rigid stringers each secured to said array at a plurality of such clips, at least some of said clips being each provided with an H-shaped block, the respective stringers being slidable in said blocks.

3. The tower defined in claim 2 wherein at least some of said clips are provided with means for tightly securing said stringers and others are provided with means permitting relative displacement of the respective stringer and said clips, said plates each further provided with horizontally extending edge strips.

* * * * *